US007731413B2

(12) United States Patent
Busin et al.

(10) Patent No.: US 7,731,413 B2
(45) Date of Patent: Jun. 8, 2010

(54) MIXER FOR MULTI-COMPONENTS SUBSTANCE FOR DENTAL CASTING

(75) Inventors: Tiziano Busin, Rovigo (IT); Massimo Rossi, Grignano Polesine (IT)

(73) Assignee: Zhermack S.p.A., Badia Polesine (IT)

( * ) Notice: Subject to any disclaimer, the term of this patent is extended or adjusted under 35 U.S.C. 154(b) by 137 days.

(21) Appl. No.: 12/034,267

(22) Filed: Feb. 20, 2008

(65) Prior Publication Data

US 2009/0207685 A1 Aug. 20, 2009

(51) Int. Cl.
*B01F 5/04* (2006.01)
*B01F 7/00* (2006.01)

(52) U.S. Cl. ..... 366/171.1; 366/172.1; 366/312; 222/145.6

(58) Field of Classification Search ... 366/172.1–172.2, 366/176.1, 181.5, 325.1, 325.2, 326.1, 329.1, 366/329.2, 312, 171.1; 222/145.5, 145.6
See application file for complete search history.

(56) References Cited

U.S. PATENT DOCUMENTS

| | | | | |
|---|---|---|---|---|
| 3,208,958 | A | 9/1965 | Jennings | |
| 4,408,890 | A * | 10/1983 | Beckmann | 366/155.2 |
| 4,454,087 | A | 6/1984 | Hayashi | |
| 4,590,030 | A | 5/1986 | Gillner et al. | |
| 5,149,720 | A | 9/1992 | DesMarais | |
| 5,249,862 | A * | 10/1993 | Herold et al. | 366/312 |
| 6,244,740 | B1 * | 6/2001 | Wagner et al. | 366/181.5 |
| 6,443,612 | B1 * | 9/2002 | Keller | 366/307 |
| 6,523,992 | B1 * | 2/2003 | Bublewitz et al. | 366/172.1 |
| 6,540,395 | B2 * | 4/2003 | Muhlbauer et al. | 366/307 |
| 6,837,399 | B1 * | 1/2005 | Wagner et al. | 222/145.6 |
| 6,837,612 | B2 * | 1/2005 | Bublewitz et al. | 366/172.1 |
| 6,932,243 | B2 * | 8/2005 | Keller | 222/145.6 |
| 7,287,898 | B2 * | 10/2007 | Pauser et al. | 366/172.1 |
| 7,320,541 | B2 * | 1/2008 | Wagner et al. | 366/172.1 |
| 2002/0175186 | A1 * | 11/2002 | Keller | 222/145.6 |
| 2003/0123323 | A1 * | 7/2003 | Bublewitz et al. | 366/172.1 |
| 2003/0137898 | A1 * | 7/2003 | Wagner et al. | 366/172.1 |
| 2004/0257909 | A1 * | 12/2004 | Pieroni | 366/172.1 |
| 2008/0087683 | A1 * | 4/2008 | Wagner et al. | 222/145.6 |
| 2009/0034357 | A1 * | 2/2009 | Gramann et al. | |
| 2009/0207685 | A1 * | 8/2009 | Busin et al. | |

FOREIGN PATENT DOCUMENTS

| | | | |
|---|---|---|---|
| DE | 4235736 | C1 * | 3/1994 |
| DE | 10043489 | A1 * | 3/2002 |
| EP | 0132169 | A1 | 1/1985 |
| EP | 0603492 | A | 6/1994 |
| EP | 1029585 | A1 | 8/2000 |
| EP | 1274501 | | 1/2003 |

(Continued)

*Primary Examiner*—Charles E Cooley
(74) *Attorney, Agent, or Firm*—Pearne & Gordon LLP

(57) ABSTRACT

A mixer adapted to mix a base and a catalyst to make a paste for dental castings has a holding body adapted to receive the components to be mixed through two inlets (3, 4). The components are conveyed into a mixing chamber (6) where a dynamic rotor (7) is present which, through suitable fins (12), allows mixing of the two components. Downstream of the dynamic mixing (7) along a feeding direction (A) of the material, a static-mixing structure (9) is also provided which is equipped with a predetermined number of shaped elements (10) to enable further mixing of the materials before the latter come out of the mixer.

32 Claims, 5 Drawing Sheets

FOREIGN PATENT DOCUMENTS

| | | | | |
|---|---|---|---|---|
| EP | 1640060 | A | | 3/2006 |
| EP | 1640060 | A1 | * | 3/2006 |
| JP | 58122029 | A | | 7/1983 |
| WO | WO 9843727 | A1 | * | 10/1998 |
| WO | WO02074426 | A1 | | 9/2002 |

* cited by examiner

MIXER FOR MULTI-COMPONENTS SUBSTANCE FOR DENTAL CASTING

FIELD OF THE INVENTION

The present invention relates to a mixer and in more detail to a mixer that is simultaneously dynamic and static and is suitable for mixing two components designed to constitute a material for dental castings.

DESCRIPTION OF THE PRIOR ART

It is known that there are presently on the market and are widely spread, devices that are designed to enable dispensing and mixing of two-component materials suitable for castings of the dental arches of a patient.

In particular, the two constituent materials (base and catalyst) are held in separate containers such as two cylindrical elements of plastic material, for example.

The containers are compatible with a machine enabling suitable dispensing of the materials by acting on pistons, placed at the inside of the containers themselves, by compression.

The mixer is connected to the openings of the containers by means of two inlets formed thereon and the shape of which matches that of the respective openings of said containers, and is also provided with a dispensing duct from which the mixed material is discharged for subsequent uses.

In particular, the mixer consists of a completely hollow body made of plastic material which at an end thereof has said inlets for admission of the base and the catalyst contained in the cylinders.

Inside the mixer there is a mixing chamber in which a rotating element is housed which is provided with suitable fins to enable optimal homogenisation of the base and catalyst.

In particular, the rotating element has an actuating shaft directly connected to the dispensing machine in such a manner that the machine itself can simultaneously urge the materials to the mixer's inlets in the desired amounts and volume ratios and can then drive in rotation the rotating element provided with fins.

The rotation speed of the fins as well as pressure imposed to the materials, and therefore the feeding speed, are such studied that an optimal base-catalyst blend is ensured, which blend therefore comes out of the dispensing outlet in a homogeneous manner.

The prior art briefly described above is illustrated for example in document EP 1274501 or EP 1368113 in the name of 3M ESPE.

The second document mentioned above discloses a dynamic mixer suitable for mixing particularly viscous substances involving use of paths of travel expressly studied for the materials entering the mixing chamber in order to avoid mutual contamination and improve the subsequent mixing. In addition it is important to notice that, when known dynamic mixers are designed to work with particularly viscous materials, the outlet section is increased so as to reduce the flow resistance.

In addition, it is known from document EP 603492 a device for mixing and distributing materials such as adhesives or sealing agents in which a first "static" component is provided, and in which each of the material components is introduced in a separate condition and distributed, being still kept separate from the other component, at a plurality of points for entry into the true dynamic mixer.

From the inlet region of the dynamic mixer on, the materials start being mixed together by an Archimedean screw driven in rotation around its axis.

Document EP 1029585, on the contrary, shows a general configuration of a mixing device adapted to be alternately used with a static-mixing screw, therefore defining a "static mixer", or with a dynamic rotor within the mixing chamber so as to define a "dynamic mixer".

As clearly described in the text, the two solutions are to be used alternately and cannot be combined together.

Although the devices briefly described above are presently widespread on the market in a plurality of different versions, the same however have some limits and/or operating drawbacks.

It is in particular to be noted that the dynamic mixers presently known do not always allow optimal mixing of the base and catalyst.

In fact, if the material viscosity, rotational speed of the dynamic element and feeding speed of the material itself within the mixer are not optimised, there is a risk of the material coming out in a non-homogeneously mixed manner thus giving rise, as a result, to subsequent problems during manufacture of the casting of the dental arch.

It is apparent that, once the mixer has been optimised, a change in the viscosity parameters necessarily involves bad mixing of the components and an important reduction in the flow rates if particularly viscous products are used.

Another negative aspect encountered above all with the most viscous products is creation of air bubbles within the mixed mass, which air bubbles result from an incorrect inner geometry.

In addition, the dynamic mixer enables a rather quick passage of the components through the mixing chamber and consequently, in order to obtain the appropriate mixing degree, rather long dynamic mixers are to be made or at all events mixers having a minimum number of mixing fins.

Finally, the sizes of the mixing chamber adversely affect the amount of material remaining within the mixer after use, which material is therefore wasted.

Accordingly, the present invention aims at substantially solving all the above mentioned drawbacks.

SUMMARY OF THE INVENTION

It is a first object of the invention to manufacture a mixer for viscoelastic materials to be used in the dental sector, which enables a homogeneous and optimal mixing of base and catalyst.

It is then an aim of the invention to avoid formation of bubbles or other mixing faults inside the mixing chamber and therefore in the discharged material.

A further aim of the invention is to manufacture a mixer enabling satisfactory flow rates to be obtained even with an important increase in the viscosity of the products.

Furthermore, it is necessary that, even when very different viscosity and consistency levels are concerned, the homogeneity of the outgoing product should be always ensured.

Auxiliary objects of the invention involve reduction in the length of the dynamic rotor and/or the number of fins used, without on the other hand adversely affecting the mixer performance.

It is a further auxiliary object to reduce the residual material inside the mixer at the end of the mixer use, thereby reducing wastes.

The invention also aims at achieving lower production costs while at the same time manufacturing a mixer which is compatible with the containers of the materials of the dispensing devices presently on the market.

The foregoing and further aims that will become more apparent in the course of the present description are substantially achieved by a mixer in accordance with the features recited in the appended claims.

Further features and advantages will be best understood from the detailed description of a preferred but not exclusive embodiment of a specific mixer for viscoelastic substances such as components of pastes for dental castings in accordance with the present invention.

BRIEF DESCRIPTION OF THE DRAWINGS

This description will be set out hereinafter with reference to the accompanying drawings, given by way of non-limiting example, in which.

DESCRIPTION OF THE PREFERRED EMBODIMENT

Figure 1:
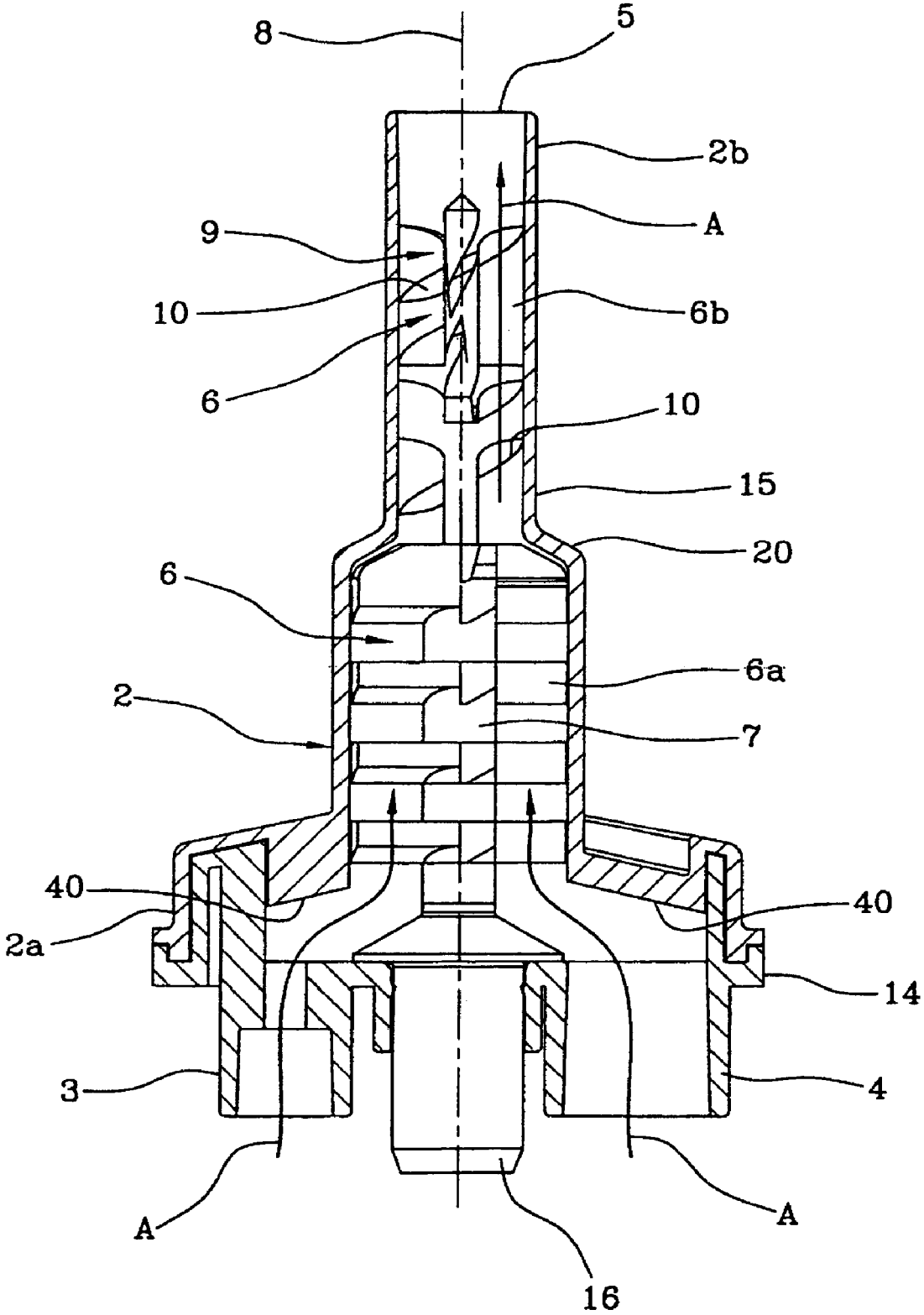
FIG. 1 is a longitudinal section of a mixer in accordance with the present invention.
Figure 2B:
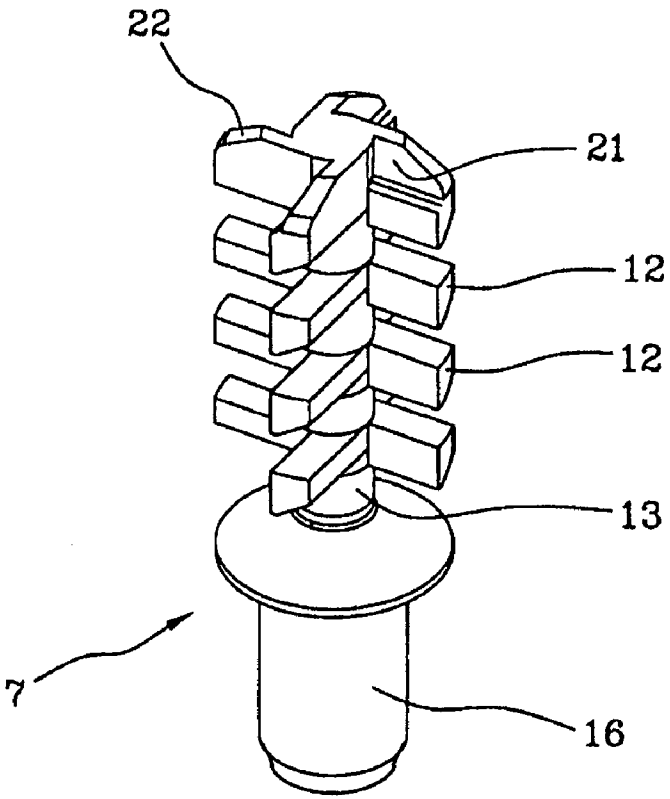
FIGS. 2*a* and 2*b* show the dynamic rotor adopted in the device of the invention.
Figure 2A:
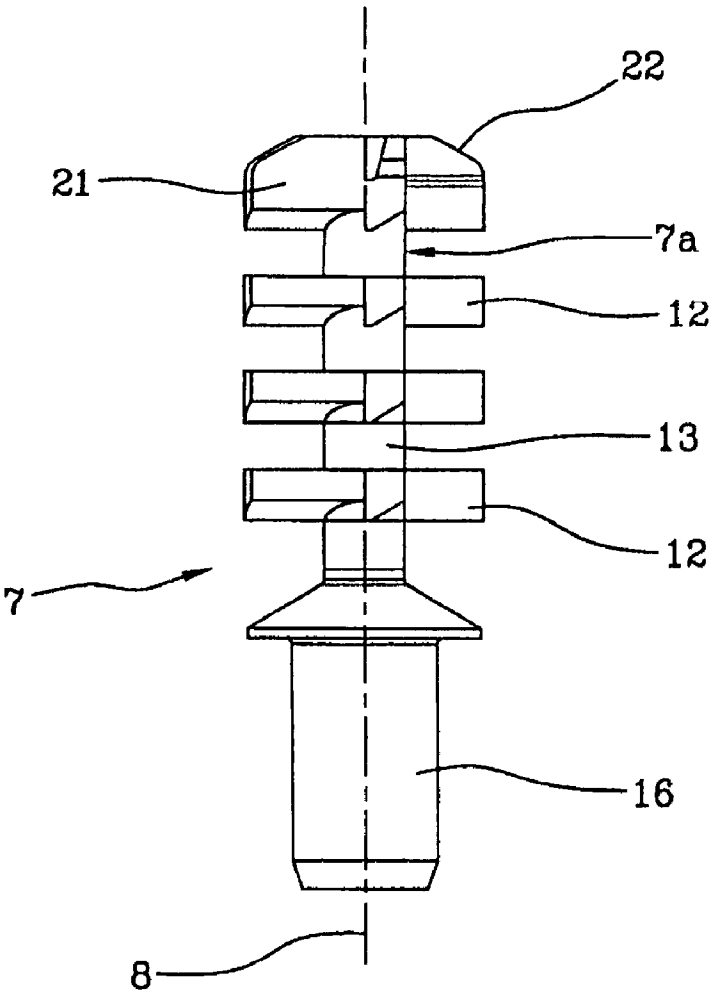

With reference to the drawings a mixer particularly adapted to mix viscoelastic substances such as a base and a catalyst being the components of pastes for dental castings has been generally identified with reference numeral 1.

Said mixer consists of a holding body 2 made of generally transparent plastic material and formed with an outer shell 15 and a base body or plate 14 sealingly coupled to the outer shell.

As can be noticed, the base plate 14 has an inlet 3 designed to receive a first component to be mixed and a second inlet 4 designed to receive the second component to be mixed.

In the embodiment shown the two components enter the mixer through the inlets 3, 4 having an axis parallel to the axis 8 of the mixer itself. It is however to be noticed that, alternatively, an inlet with an inclined axis transverse to the symmetry axis 8 can be provided too.

As can be viewed from FIG. 1, the flow of the components is then submitted to a deviation forcing them to enter the mixing chamber with a direction transverse to the rotation axis 8. This deviation is in particular caused by the presence of inclined lower surfaces 40 of the outer shell 15.

Figure 3A:
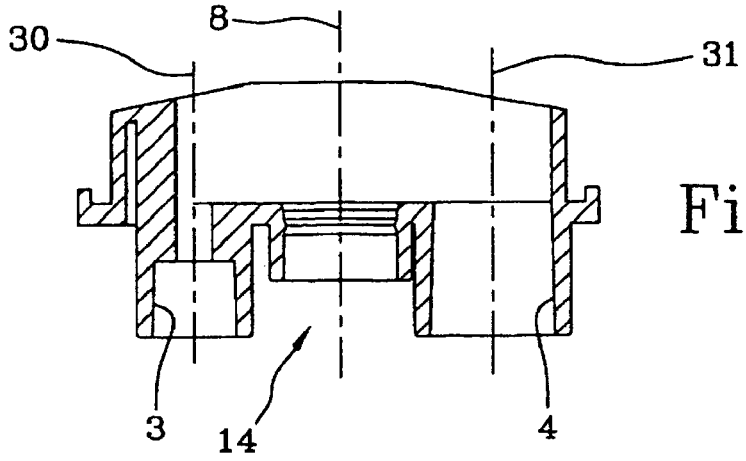
FIGS. 3*a*, 3*b* and 3*c* show the base body of the mixer seen in FIG. 1.
Figure 3C:
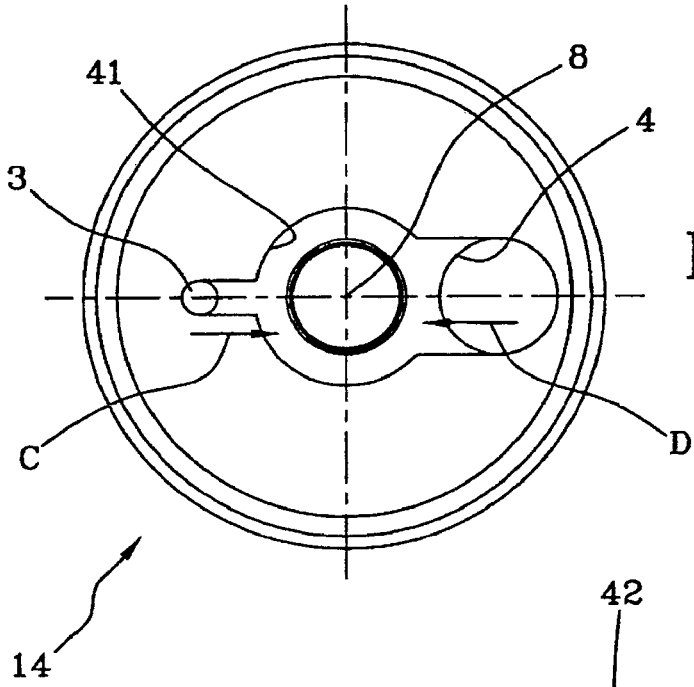
Figure 3B:
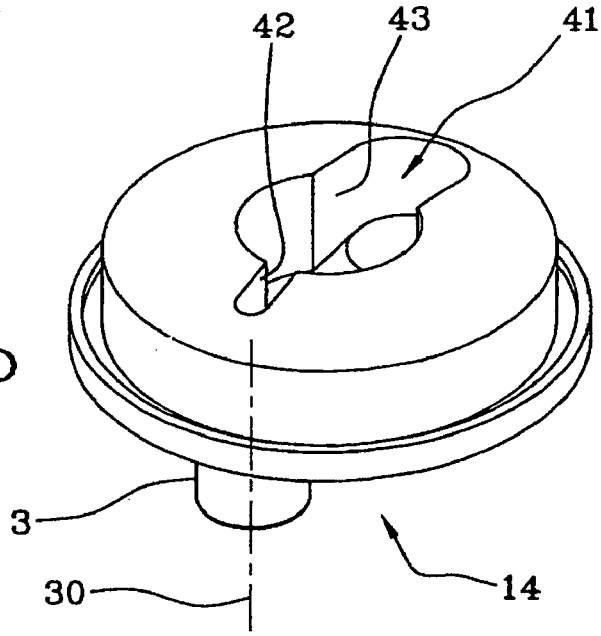
Figure 4B:
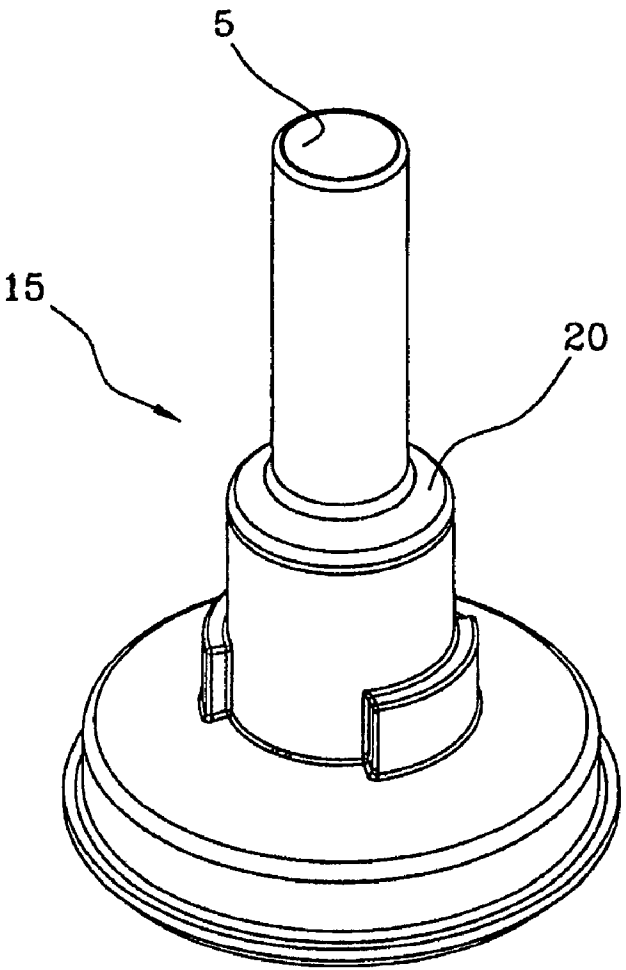
FIGS. 4*a* and 4*b* show the outer shell of the mixer seen in FIG. 1.
Figure 4A:
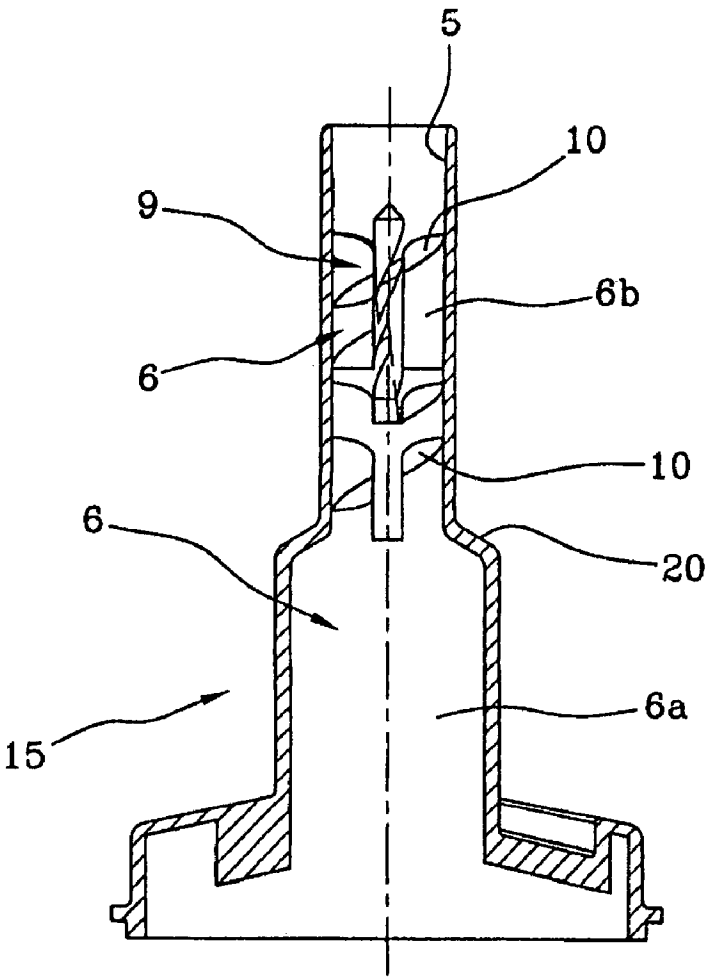

Still from the point of view of the entry directions and looking at FIGS. 3*b* and 3*c*, it is possible to see that the incoming substances are directed perpendicular to the axis 8 of the mixer in a horizontal plane (directions C, D in FIG. 3*c*).

In detail, the base plate 14 and outer shell 15 in co-operation define a pre-chamber 41 for entry of the components, which is capable of deviating the incoming flow from parallel to the axis 8 of the mixer to inclined to the axis itself by means of the inclined surfaces 40 and also radially directed (directions C, D) towards the axis itself through suitable shaped ducts 42, 43.

Alternatively (FIG. 6), the shaped ducts 42, 43 can be inclined in the plane so that the two components are directed to the pre-chamber 41 with inclined directions and opposite ways in the plane (directions $C^1$, $D^1$); in this manner an improvement in mixing can be obtained which can be useful in particular as far as rather viscous substances are concerned.

It is finally to be noted that the pre-mixing chamber 41 is not concerned with any fin 12 that could incorporate air bubbles during mixing.

Figure 6:
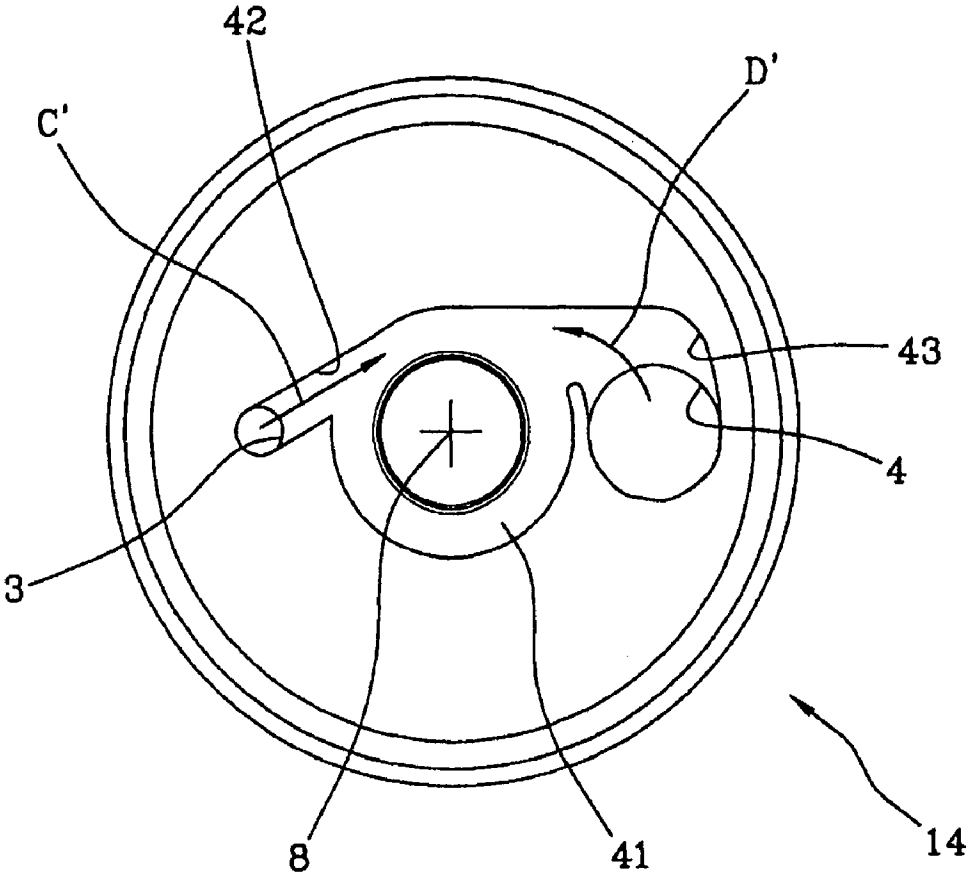
FIG. 6 shows an alternative embodiment of the base body of the mixer.

At all events, also the embodiment shown in FIG. 6 contemplates direct entry of the materials into the pre-mixing chamber 41 without any delay being involved, but merely making the two flows run in opposite directions.

In this manner better mixing can be ensured under some situations because the materials enter the mixing chamber with optimal flow inclinations and velocities, that are not necessarily parallel to axis 8.

The holding body 2, and in detail the outer shell 15 have a longitudinal extension starting from a first end 2*a* where the base plate 14 is, as far as an opposite end 2*b* where an outlet 5 is defined which is adapted to enable the mixed material to go out.

Defined within the holding body 2 is a mixing chamber 6 in which the two components introduced through the inlets 3, 4 are intimately mixed until the desired homogeneity, being then discharged through the outlet 5.

It is possible to see the presence of a dynamic-mixing element 7 a portion 7*a* of which, made up of the central core 13 and a predetermined number of fins 12 radially emerging therefrom, is positioned movable in rotation around its longitudinal extension axis 8 inside the mixing chamber 6.

For the purpose, the dynamic-mixing element 7 is provided with a shaped lower attachment 16 designed to be engaged by actuating means (a suitable rotating shaft, for example) that can set it in rotation. This actuating means is not shown or further described as it is of a known type presently on the market.

In detail the dynamic-mixing element 7 takes up a first region 6*a* of the mixing chamber 6 generally having a cylindrical conformation with a constant passage section.

The strictly cylindrical shape of the mixing chamber section however is not binding, but a section having a portion becoming larger or narrower towards the outlet can be also conceived.

In addition, in the embodiment shown there is the presence of a tapering portion 20 (of frustoconical shape) connecting the first region 6*a* to the second region 6*b* of the mixing chamber 6.

Within the first region 6*a* the fins 12 preferably placed at different heights along the extension axis 8 of the mixing element and in a suitable number for each level (in the embodiment shown four fins spaced apart through 90° for each of the four levels), extend from the central core 13 as far as the inner surface of the first region 6*a* of the mixing chamber so that substantially the whole section is concerned therewith.

Figure 5:
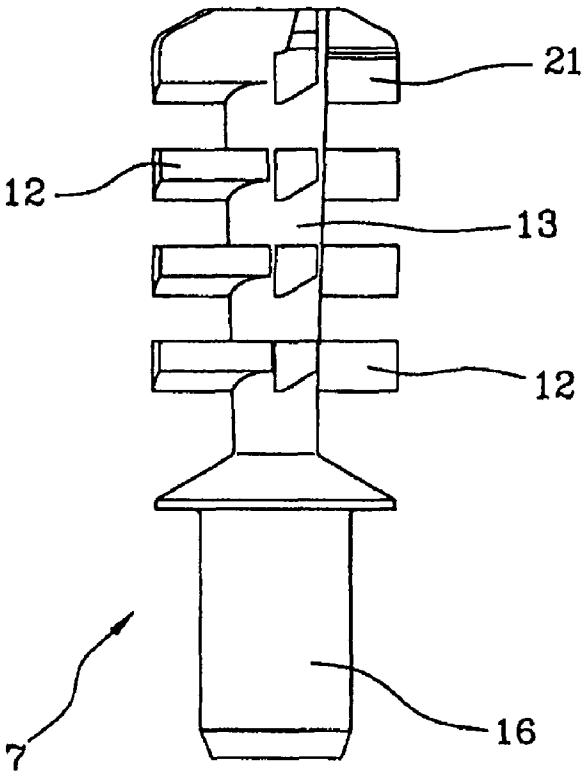
FIG. 5 shows an alternative embodiment of a dynamic mixer in accordance with the invention.

In particular, the fins of the rotating shaft are differentiated as follows; a first series has a slender shape, while the end fins 21 are larger and at the upper part thereof have scrapers 22 that nearly touch the inner walls of the tapering portion 20. Alternatively, adoption of a frustoconical central core 13 becoming larger from the base to the outlet (FIG. 5) can be provided. This involves a further narrowing of the free passage section for the material flowing therethrough. Obviously a frustoconical central core 13 becoming narrower towards the outlet 5 is also possible.

As shown in the accompanying drawings, downstream of the dynamic-mixing element 7 along the feeding direction A of the material there is a further mixing structure of the static type 9 comprising a plurality of shaped elements 10 adapted to enable a further subsequent mixing of the materials before they come out of the mixer.

In particular, the static-mixing structure 9 is placed immediately downstream of the dynamic-mixing element 7 and exactly terminates at the outlet 5.

Said structure 9 is rigidly secured to the holding body and in particular to a second region 6*b* of the mixing chamber 6.

It is to be pointed out that the second region 6*b* has an average passage section smaller than the average passage section of the first region 6*a*. Generally, the second region 6*b* too will be of cylindrical conformation and will have a constant passage section.

It is also to be pointed out that the static elements 10 of structure 9 define fixed paths for the material flowing through the mixer. These paths are directed transversely of the extension axis 8 of structure 9.

In addition, due to passage of said material through such shaped elements in succession, the material is forced to take directions transverse to each other along the feeding travel.

From a geometric point of view, the elements 10 of the static-mixing structure 9 comprise an Archimedean screw portion in which the surfaces force the material passing therethrough to spin around the mixer axis 8.

If there is more than one Archimedean screw portion, they will be angularly offset through 90°.

Obviously, the number of these elements can be stated depending on the material viscosity, the necessary mixing degree to be obtained, the flow resistance generated by this static mixer and all the other design specifications affecting the choice.

For instance, a mixer can be manufactured which has one to four of said shaped surfaces 10.

After the above description, operation of the mixer in accordance with the invention is as follows.

Each of the two components is forced by a dispensing machine to enter the mixer under pressure, through the first and second inlets 3, 4 having differentiated passage sections so as to obtain the desired volume ratios between the two products at the entry. Here the base and catalyst are submitted to a first mixing step within the first three fourths of chamber 6, said first mixing step being carried out by the dynamic-mixing element rotating around its axis 8. In the remaining fourth, before entering the static mixer, due to the shape of the last mixing fins 21 and the flow resistance caused by the static element, mixing has a further improvement.

The material moves forward from the inlets 3, 4 as far as the outlet 5 due to pressure of the incoming material generated by the dispensing machine.

The material, after being mixed in chamber 6*a* by the dynamic mixer 7, is forced to pass through the second region 6*b* of the mixing chamber where the static-mixing structure 9 described above is located, which structure induces a third additional mixing operation. Then the material comes out of the outlet 5 so that it can be used.

The invention achieves important advantages.

It is to be pointed out first of all that adoption of a mixer consisting of a first dynamic portion and a second static portion improves homogeneity of the outgoing material.

In fact, the static portion of the mixer slows down the overall feeding speed of the material that therefore is obliged to remain inside the dynamic-mixing region longer.

Due to the above, the dynamic-mixing element 7 can ensure better homogenisation of the materials without too long lengths and/or too many fins being required.

Besides being a region acting as a "plug", i.e. a region enabling slowing down of the material speed, the static mixer is able to carry out an additional mixing operation that further improves the properties of the outgoing material. Therefore, due to the presence of this static-mixing structure 9, the mixer can also operate with substances of different viscosity and obtain a good mixing degree in all cases.

In addition, in contrast to common beliefs, the end obstruction does not reduce the flow rate if suitable expedients to improve the flow in the other mixer sections are adopted.

The static element introduces an obstruction that, if suitably studied, enables mixing of the dynamic mixer to be improved and optimisation of the mixing operation to be carried out in the final portion of the mixer itself.

Finally, due to the presence of a smaller number of fins of slenderer geometry, heating of the material passing through the mixer is reduced and furthermore, being the mixing chamber of smaller volume, material wastes are reduced too.

The invention claimed is:

1. A mixer for viscoelastic two-component substances for dental castings, comprising:

a holding body which at one end has at least one inlet for a first component to be mixed and at least one inlet for a second component to be mixed, the holding body further having an outlet disposed to an opposite end relative to the inlets and in fluid communication with them, the outlet being adapted to enable discharge of the mixed substance, the holding body defining a mixing chamber at the inside thereof;

a dynamic-mixing element having at least one portion placed inside the mixing chamber, movable in rotation around its longitudinal extension axis and having fins lapping said holding body to enable mixing of the two components, a static-mixing structure provided downstream of the dynamic-mixing element along a material feeding direction, the static-mixing structure comprising a predetermined number of shaped elements rigidly secured to the holding body and having the form of an Archimedean screw portion for forcing the material passing therethrough to spin around the longitudinal extension axis and further mixing the two components before discharge from the mixer.

2. A mixer as claimed in claim 1, wherein the mixing chamber comprises a first region into which the dynamic-mixing element rotates with fins lapping said holding body, and a second region containing the static-mixing structure, the first region having an average passage section wider than the average passage section of the second region.

3. A mixer as claimed in claim 2, wherein the second region is of cylindrical conformation and has a constant passage section, the first region too being of cylindrical conformation and having a constant passage section, the two regions being mutually connected by a tapering portion lapped by the material.

4. A mixer as claimed in claim 3, wherein the static-mixing structure intercepts a whole passage region of the substances.

5. A mixer as claimed in claim 3, wherein the dynamic-mixing element further comprises end fins radially emerging from a central core, said end fins having scrapers at their upper part which substantially conform in shape to inner walls of the tapering portion.

6. A mixer as claimed in claim 3, wherein the dynamic-mixing element comprises end fins radially emerging from a central core, said end fins comprising scrapers at their upper part which substantially conform in shape to the inner walls of the tapering portion, whereby the end fins are larger than other fins of the dynamic-mixing element due to the presence of the scrapers, the shape of the end fins and the flow resistance caused by the static-mixing structure improving the mixing.

7. A mixer as claimed in claim 3, wherein the second region has the same passage section of the outlet of the mixer.

8. A mixer as claimed in claim 3, wherein the static-mixing structure is placed immediately downstream of the dynamic-mixing element and of the tapering portion and terminates at the outlet.

9. A mixer as claimed in claim 1, wherein the shaped elements of the static-mixing structure define fixed paths for the material, the fixed paths being directed transversely of an extension axis of the structure, said fixed paths in turn defining mutually transverse directions for the material flowing along a feeding travel of the material itself.

10. A mixer as claimed in claim 9, wherein the shaped elements of the static-mixing structure comprise a central core from which the shaped elements emerge.

11. A mixer as claimed in claim 1, wherein the static-mixing structure is placed immediately downstream of the dynamic-mixing element and terminates at the outlet.

12. A mixer as claimed claim 1, wherein the holding body defines a pre-chamber capable of deviating the flow of the incoming substances from parallel to the longitudinal extension axis to inclined through inclined surfaces.

13. A mixer as claimed in claim 12, wherein the pre-chamber has shaped ducts to force the two substances to the entry according to opposite directions and ways.

14. A mixer as claimed in claim 1, wherein said fins radially emerge from a central core, the fins being placed to different heights along the longitudinal extension axis of the mixing element.

15. A mixer as claimed in claim 1, wherein the dynamic-mixing element comprises a central core of frusto-conical conformation having a section becoming continuously larger from the inlets towards the mixer's outlet.

16. A mixer as claimed in claim 1, wherein the holding body comprises an outer shell and a base plate sealingly coupled to the outer shell, the base plate being provided with said inlets, which inlets have different entrance sections to enable entry of said first and second components to predetermined volume ratios.

17. A mixer as claimed in claim 16, wherein the base plate has shaped ducts inclined in a plane perpendicular to the longitudinal extension axis of the dynamic-mixing element, with respect to the radial direction, whereby the two components are directed to a pre-chamber with inclined directions and opposite ways in the plane.

18. A mixer as claimed in claim 16, wherein the base plate has shaped ducts radially directed towards the longitudinal extension axis of the dynamic-mixing element.

19. A mixer as claimed in claim 1, wherein the static mixing structure introduces an obstruction enabling mixing of the dynamic mixer to be improved and optimizing mixing operation carried out in a final portion of the mixer.

20. A mixer as claimed in claim 1, wherein the dynamic-mixing element is wider than the static-mixing structure with regard to a dimension transverse to the longitudinal extension axis.

21. A mixer as claimed in claim 1, wherein the holding body defines a pre-chamber disposed between the inlets for the first and second component and the mixing chamber and not concerned with any fin whereby avoiding incorporate air bubbles during mixing.

22. A mixer as claimed in claim 1, wherein the elements of the static-mixing structure comprise more than one Archimedean screw portion angularly offset through 90°.

23. A mixer as claimed in claim 1, wherein the elements of the static-mixing structure comprise one to four of Archimedean screw portion angularly offset through 90°.

24. A mixer as claimed in claim 1, comprising from the inlets towards the outlet:

a pre-mixing chamber not concerned with any fin, a first region containing the dynamic-mixing element having a predetermined number of fins radially emerging from a central core, and a second region containing the shaped elements of the static-mixing structure defining fixed paths for the material, the fixed paths being directed transversely of an longitudinal extension axis of the structure defined by a central core of the static-mixing structure from which the shaped elements emerge, the pre-mixing chamber having wider transverse dimensions with respect to the longitudinal extension axis than the first region and the first region having wider transverse dimensions with respect to the longitudinal extension axis than the second region.

25. A mixer for viscoelastic two-component substances for dental castings, comprising:

a holding body which at one end has at least one inlet for a first component to be mixed and at least one inlet for a second component to be mixed, the holding body further having an outlet disposed to an opposite end relative to the inlets and in fluid communication with them, the outlet being adapted to enable discharge of the mixed substance;

a mixing chamber defined within the holding body and presenting:

a first region acting on said components for mixing the same, said first region having a first passage section, and a second region acting on the components on which the first region has already acted, said second region having a second passage section; said first passage section having an area wider than the area of said second passage section;

a dynamic-mixing element rotatable within said first region of the mixing chamber and acting on the whole first passage section, a static-mixing structure provided downstream of the dynamic-mixing element and comprising an Archimedean screw structure acting on the whole second passage section.

26. A mixer for viscoelastic two-component substances for dental castings, comprising:

a holding body which at one end has at least one inlet for a first component to be mixed and at least one inlet for a second component to be mixed, the holding body further having an outlet disposed to an opposite end relative to the inlets and in fluid communication with them, the outlet being adapted to enable discharge of the mixed substance, a mixing chamber defined within the holding body and presenting:

a first region acting on said components for mixing the same, said first region having a first passage section, and a second region acting on the components on which the first region has already acted, said second region having a second passage section; said first passage section having an area wider than the area of said second passage section;

a dynamic-mixing element rotatable around its longitudinal extension axis within said first region of the mixing chamber and acting on the whole first passage section, the dynamic-mixing element having fins lapping said holding body, a static-mixing structure introducing an obstruction provided downstream of the dynamic-mixing element along a material feeding direction, the static-mixing structure comprising a predetermined number of shaped elements rigidly secured within the second region of the holding body intercepting the whole second passage section of the substances, the dynamic-mixing element being wider than the static-mixing structure with regard to a dimension transverse to the longitudinal extension axis.

27. A mixer as claimed in claim 26, wherein the second region is of cylindrical conformation and has a constant passage section, the first region too being of cylindrical conformation and having a constant passage section, the two regions being mutually connected by a tapering portion, the static-mixing structure being placed immediately downstream of the dynamic-mixing element and of the tapering portion and terminating at the outlet.

28. A mixer as claimed in claim 27, wherein the second region has the same passage section of the outlet of the mixer.

29. A mixer as claimed claim 26, wherein the holding body defines a pre-chamber capable of deviating the flow of the incoming substances from parallel to the longitudinal extension axis inclined through inclined surfaces.

30. A mixer as claimed in claim 26, wherein the holding body defines a pre-chamber disposed between the inlets for the first and second component and the mixing chamber and not concerned with any fin whereby avoiding incorporate air bubbles during mixing.

31. A mixer as claimed in claim 26, wherein the elements of the static-mixing structure comprise more than one Archimedean screw portion angularly offset through 90°.

32. A mixer as claimed in claim 26, comprising from the inlets towards the outlet:

a pre-mixing chamber not concerned with any fin, a first region containing the dynamic-mixing element having a predetermined number of fins radially emerging from a central core and a second region containing the shaped elements of the static-mixing structure defining fixed paths for the material, the fixed paths being directed transversely of an longitudinal extension axis of the structure defined by a central core of the static-mixing structure from which the shaped elements emerge, the pre-mixing chamber having lower transverse dimensions with respect to the longitudinal extension axis than the first region and the first region having lower transverse dimensions with respect to the longitudinal extension axis than the second region.

* * * * *